United States Patent [19]

Milberger et al.

[11] Patent Number: 4,893,070

[45] Date of Patent: Jan. 9, 1990

[54] DOMINO EFFECT SHUNT VOLTAGE REGULATOR

[75] Inventors: Walter E. Milberger, Severna Park; Charles S. Kerfoot, Pasadena; Franklin B. Jones, Catonsville, all of Md.

[73] Assignee: The United States of America as represented by the Secretary of the Air Force, Washington, D.C.

[21] Appl. No.: 318,210

[22] Filed: Feb. 28, 1989

[51] Int. Cl.[4] ..... G05F 1/44

[52] U.S. Cl. ..... 323/270; 323/350

[58] Field of Search ..... 323/225, 226, 268, 270, 323/271, 280, 350, 351

[56] References Cited

U.S. PATENT DOCUMENTS

| | | | |
|---|---|---|---|
| 3,551,788 | 9/1968 | Summer | 323/270 |
| 3,623,140 | 11/1971 | Nercessian | 323/268 |
| 3,946,303 | 3/1976 | Streit et al. | 323/280 |
| 4,400,660 | 8/1983 | Schaefer | 323/270 |
| 4,429,416 | 1/1984 | Page | 455/211 |
| 4,495,429 | 1/1984 | Oda et al. | 307/491 |

*Primary Examiner*—Patrick R. Salce
*Assistant Examiner*—Kristine Peckman
*Attorney, Agent, or Firm*—Bernard E. Franz; Donald J. Singer

[57] ABSTRACT

A High Voltage Regulation apparatus which uses an amplifier having an arbitrarily large number of stacked MOSFETs to provide low impedance shunt regulation with a "domino effect". Voltages of many kilovolts can be conveniently regulated. voltage sharing among the devices is assured by the domino arrangement. External capacitances are added to optimize low impedance voltage regulation, including an external capacitor connected between the drain and gate of each stage to equalize the drain to gate and gate to source capacitances. There may also be an external capacitor connected between the drain and source of each stage to provide low amplifier impedance at high frequency, or a lumped external capacitor connected across the entire amplifier string, to provide low amplifier impedance at high frequency. The amplifier uses a unity-gain inverting amplifier as its basic building block. N-number of these building blocks are stacked to accommodate whatever voltage stand-off level is desired.

4 Claims, 2 Drawing Sheets

DOMINO EFFECT SHUNT VOLTAGE REGULATOR

RIGHTS OF THE GOVERNMENT

The invention described herein may be manufactured and used by or for the Government of the United States for all governmental purposes without the payment of any royalty.

BACKGROUND OF THE INVENTION

The present invention relates generally to a high voltage shunt voltage regulator, using a linear FET amplifier which operates at voltage levels of up to tens of thousands of volts with power dissipation capabilities in the kilowatt range.

There are known shunt voltage regulators using cascode techniques, in which the higher stages require a direct reference to the lower stage. This direct reference becomes quite complicated when using more than two or three devices.

United States patent references of interest include No. 3,623,140 to Nercessian, which shows a plurality of power supplies connected in cascade and interconnected in such a manner as to provide that they share the load in predetermined ratios. Overall stability is determined substantially solely by the characteristics of the master supply. U.S. Pat. No. 4,429,416 to Page is concerned with differential amplifier stages cascaded in a directly coupled configuration. The patented circuit acts not only as an IF amplifier, but also as a signal limiter. A limiter amplifier with cascade-connected differential amplifier stages is also shown in Oda et al U.S. Pat. No. 4,495,429. Summer in U.S. Pat. No. 3,551,788 describes a high voltage transistorized stack, and Schaefer in U.S. Pat. No. 4,400,660 shows a high voltage power supply regulator combined with a modulator. A voltage regulator which includes a differential amplifier is described in Streit et al U.S. Pat. No. 3,946,303.

SUMMARY OF THE INVENTION

An object of the invention is to provide an improved high voltage shunt regulator.

This invention is directed to a high voltage regulator which uses an arbitrarily large number of stacked MOSFETs in a low impedance shunt regulation configuration. Voltages of many kilovolts can be conveniently regulated. The system uses a bias network which makes each stage into a unity gain closed loop amplifier. This bias network consists of two high valued resistors. A closely regulated voltage is produced connecting a power supply, through an impedance, to the amplifier. The regulated voltage output is at the top of the stack and the bottom FET is driven by a voltage reference. Compensation is provided by connecting an external capacitor from the drain to the gate of each FET in the stack.

Novel and Useful Features of the Domino Effect Voltage Regulator Include:

1. The use of a Domino Effect Amplifier as a shunt voltage regulator for high voltage.

2. The addition of external drain to gate capacitance to reduce the impedance of the Domino Effect Amplifier, which at low frequencies is inversely proportional to the voltage source impedance.

3. The use of an external drain to gate capacitor to equalize the drain to gate and gate to source capacitances, to provide constant transfer of voltage variations on the drain to the gate of the FET at all frequencies.

4. The use of a larger drain to gate capacitance to provide lower impedance at intermediate frequencies in the Domino Effect Amplifier.

5. The use of a drain to source capacitor across the FETs to provide lower amplifier impedance at high frequency.

6. The use of a lumped drain to source capacitor across the entire amplifier string to provide lower impedance at high frequencies in the Domino Effect Amplifier.

DETAILED DESCRIPTION

A related system called "Domino Effect Amplifier" by the same applicants is covered by a copending patent application Ser. No. 07/318,211, filed, Feb. 28, 1989, which is hereby incorporated by reference.

Introduction

The Domino Effect Amplifier uses stacked MOSFETs operated in linear mode to provide high voltage linear amplification. Each FET in the stack is connected to an adjacent FET for bias and signal flow. With this arrangement an arbitrarily large number of devices can be stacked to provide operation at many kilovolts. The Domino Arrangement is superior to known cascode techniques, in which the higher stages require a direct reference to the lowest stage. This direct reference becomes quite complicated when using more than two or three devices.

When used as a shunt regulator, the basic Domino Effect Amplifier performs very well across a limited bandwidth. At higher frequencies, however, the amplifier's ripple rejection decreases. This degradation is due in large part to the high gate to source capacitance present in the MOSFETs, combined with the high values used for bias resistors.

This disclosure presents a variation on the Domino Effect Amplifier which optimizes the circuit for use as a shunt voltage regulator, through the addition of external drain to gate capacitors. These capacitors improve the high frequency rejection of the amplifier by compensating for high gate to source capacitance. With this compensation the performance at high frequency can equal or exceed the low frequency performance.

Principles of Operation of the Domino Effect Amplifier

Figure 1:
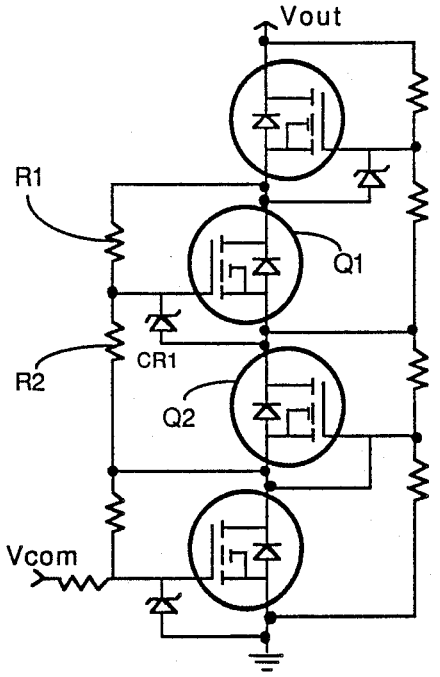
FIG. 1 is a schematic circuit diagram showing a domino effect amplifier.

The Domino Effect Amplifier uses a bias network which makes each stage into a unity gain closed loop amplifier. This bias network consists of two high valued resistors, connected to each FET stage as shown in FIG. 1. Q1 is any FET in the stack except for the bottom transistor. Resistor R1 is connected to the gate of the FET and to the drain. The voltage across R1 will be equal to the voltage across the conduction channel of the FET, which will typically be several hundred volts, with an error of a few volts equal to the gate threshold voltage.

Resistor R2 is connected from the gate of Q1 to the source of the transistor stacked immediately below Q1, shown as Q2. The voltage across resistor R2 will be equal to the voltage across the conduction channel of Q2, again with an error equal to the gate threshold voltage of Q1.

Zener diode CR1 is included only to protect against sudden voltage transients which could damage the FET gate. It plays no part in normal circuit operation.

The gate of a MOSFET presents a very high impedance at low frequencies, being capacitive in nature. This requires that all current through resistor R1 flows through resistor R2, and if resistors R1 and R2 are equal, that the voltage across the two resistors be equal. If the voltage across resistor R1 were greater, then the gate voltage would increase to restore equilibrium. This increase in gate voltage would in turn cause a greater current to flow through Q1, which would lower the voltage across resistor R1. This negative feedback assures that the voltage across Q1 will remain equal to the voltage across Q2. By extension of the principle to other stages, the stack can be extended to any desired length, with each stage duplicating the voltage across the one below.

For the first transistor in the string, the bias resistor R2 cannot be connected to the FET below, as there is none. For this stage, the bias resistor is connected instead to an external signal source. This external source commands the operation of the first stage, which will be duplicated by all the stages above it.

Performance Limitations of the Domino Effect Amplifier

Figure 2:
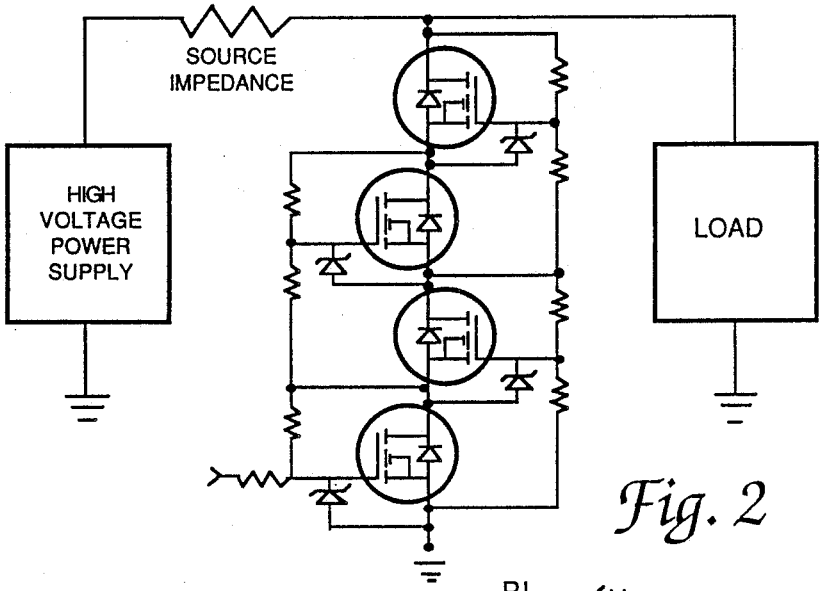
FIG. 2 is a functional block and schematic circuit diagram showing a domino effect amplifier shunt voltage regulator.

A natural use for the Domino Effect Amplifier is as a high voltage shunt regulator, in which a closely regulated voltage is produced by connecting a power supply, through an impedance, to the amplifier as shown in FIG. 2. The regulated voltage output is at the top of the amplifier stack. The bottom FET is driven by a voltage reference.

The important criteria for such a regulator are that it have a wide current range, to handle variations in the load requirements and the supply output; and that it handle these current variations with minimal variation in output voltage.

The Domino Effect Amplifer meets the first requirement exceptionally well, and does well with the second from DC to moderate frequencies. At higher frequencies, however, the rejection of the amplifier begins to degrade. This is a significant concern, because the rejection at power supply ripple frequencies, which range from 360 Hertz on up to hundreds of kilohertz, will fall off.

Figure 3:
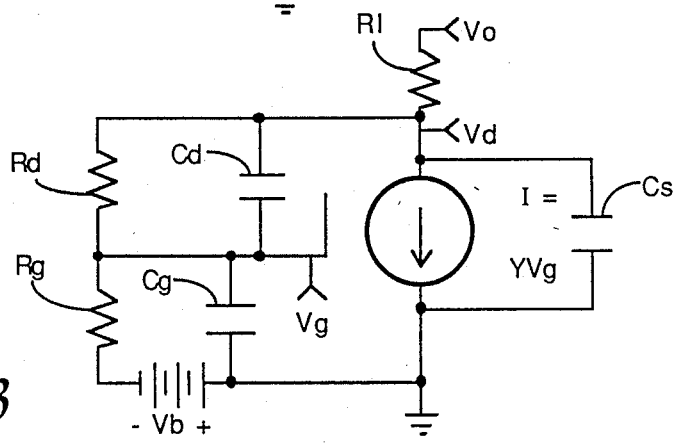
FIG. 3 is a schematic circuit diagram of a model used for analysis.

The reason for this performance degradation at high frequencies can be seen by modeling a single stage of the amplifier with the circuit in FIG. 3. The effects of the load and all higher level FETs are replaced by a lumped impedance labeled RL. The FET directly below in the stack, which is the one which controls the operation, is represented by a bias voltage supply. The behaviour of this supply can account for all of the effects of the lower FETs.

The drain bias resistor is labeled Rd. The gate to source zener is ignored. The FET itself is replaced by a voltage controlled current source, which passes a current through the conduction channel proportional to the gate to source voltage Vg. Also included in the FET model are three internal capacitances between the FET terminals.

The gate to source capacitance Cg is the largest of these, with a value on the order of 1000 pf. The drain to gate capacitance Cd is about 50 pf. The drain to source capacitance Cs is about 100 pf. Resistors R1 and R2 will have values of 1 megohm or more.

For the previous description of the operation of the Domino Effect Amplifier, it was assumed that the gate was a very high impedance. With the large gate capacitance, this is not true at higher frequencies. At frequencies above the corner set by resistance Rd and capacitance Cg, which is about 200 Hertz, the response of the amplifier will fall off. Variations in the voltage at the drain, which would be coupled directly to the gate, will be filtered by the R-C network. In effect, the capacitance Cg by-passes the signal around the gate. In terms of the operation of the shunt regulator, this means that higher frequency ripple and load variations will not be suppressed by the amplifier

New Compensation Method for the Domino Effect Amplifier

The R-C corner establishes a point at which the performance of the amplifier will begin to degrade. This corner can be moved within limits to provide a wider ripple rejection bandwidth. Some FETs have lower gate capacitance than others, but if high voltage and high power are required, very little improvement is available here.

The other option is to decrease the value of the bias resistors. If this is done, however, the current through the resistors quickly becomes excessive. Unfortunately, very little improvement in bandwidth can be achieved this way.

The new compensation method for the Domino Effect Amplifier uses an external capacitor connected from the drain to the gate of each FET in the stack. This capacitor is chosen to make the total drain to gate capacitance equal to the gate to source capacitance. In the case that the two bias resistors are not equal, the value of the capacitor is chosen to make the product of resistance Rg and capacitance Cd equal to the product of resistance Rd and capacitance Cg.

With the amplifier compensated in this manner, voltage variations at the drain are coupled directly to the gate at all frequencies. This allows the FET to respond fully to variations at higher frequencies, for example those due to power supply ripple.

Circuit Analysis

The response of the circuit to voltage variations can be found in terms of two ratios; the ratio of the gate voltage to the drain voltage, called $\alpha$; and the ratio of the drain voltage to the applied voltage, called $\beta$. These ratios are found to be $$\alpha = \frac{V_q}{V_d} = \frac{1 + i\omega C_d R_d + \frac{V_b}{V_d}\frac{R_d}{R_g}}{1 + i\omega(C_d + C_g)\,R_d + \frac{R_d}{R_d}}$$

AND

-continued $$\beta = \frac{V_d}{V_o} = \frac{1}{1 + \alpha y R_L - (\alpha - 1)\left[\frac{R_L}{R_d} + i\omega C_d R_L\right] + i\omega C_s R_L}$$

Y will have a value near one ohm, and $R_d$ will be at least a Megohm, so that the low frequency impedance is the inverse of the source impedance. With a source impedance of as little as hundreds of ohms, which is not very high for a high voltage application, the regulator will present an impedance of milliohms.

In the very high frequency limit, the capacitances come into play, so that $$\beta = \frac{1}{1 + \frac{1}{2} YR_L + i\omega R_L (\frac{1}{2} C_d + C_s)}$$

Here it is seen that two approaches are possible. If $C_s$ is large, the impedance becomes low at high frequencies, because this capacitance shunts the amplifier. Changes in $C_d$, on the other hand, appear both directly and in the $\alpha$ term. Thus the increase in $\alpha$ tends to reduce the benefit gained from additional drain to gate capacitance. The function is monotonic, so that any increase in $C_d$ will decrease the amplifier impedance, regardless of other component values. Once $C_d$ exceeds the value of $C_g$ though, much less benefit is gained from additional capacitance.

It is seen then that the circuit can be made to have a much lower impedance by the addition of two capacitors to each stage; one from drain to gate, such that the drain-gate capacitance is equal to or greater than the gate-source capacitance; and one from drain to source, of any value desired. As a practical alternative to this, the drain-source capacitances for all of the stages could be combined across the string. Since there will in most applications be a filter capacitor near the output, this will not require an extra component, so that the response of the amplifier is optimized with a single component at each stage.

Experimental Verification

Figure 4:
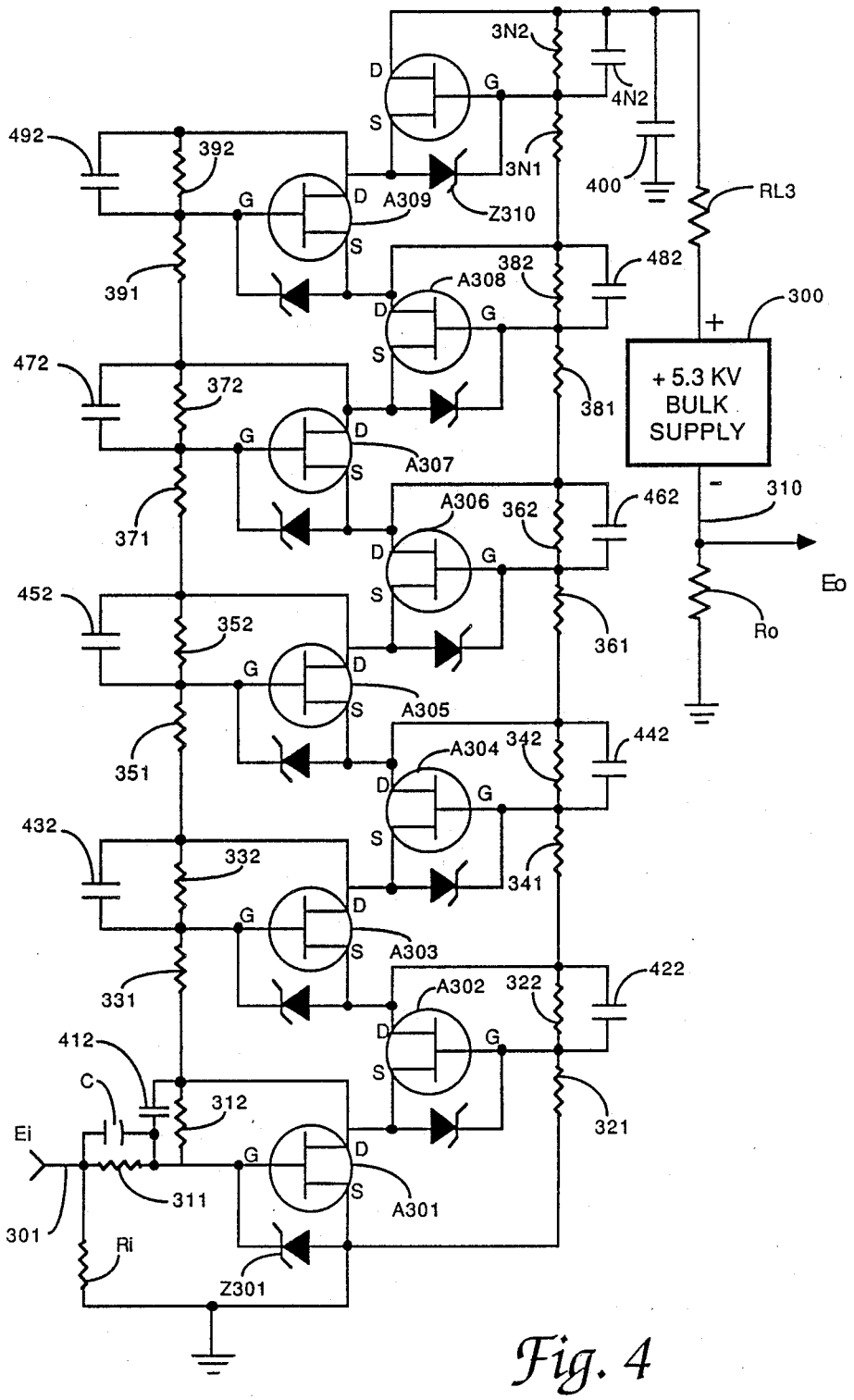
FIG. 4 is a schematic circuit diagram of a domino effect amplifier used experimentally as a shunt regulator.

A Domino Effect Amplifier, consisting of ten 1000-volt FETs, was modified to include drain to gate capacitors as shown in FIG. 4. A lumped drain to source capacitor 400 was included across the entire string. Several values were tried for the drain to gate capacitors.

FIG. 4 shows the schematic diagram of a breadboard circuit used to verify the operation of the Domino Effect Amplifier. An over-drive capacitor C is used on the first stage for frequency enhancement. The circuit uses ten 1,000-volt field effect transistors (FET's) A301–A310 (all N-channel type MTP1N100) connected in the manner described above (Domino Connection). For each transistor, the gate G is the inverting input, the source S is the non-inverting input or common terminal for the stage, and the drain D is the output. Zener diodes Z301–Z310 (type 1N759A) connected between the gate and source of the FET's are necessary to prevent gate to source voltage avalanche when the supply voltage is first applied.

The input Ei to the amplifier is applied at lead 301, with a 100-ohm resistor Ri connected from lead 301 to ground. The output Eo from the amplifier appears at lead 310, with a 1-megohm resistor Ro connected from lead 310 to ground. A 100-ohm limiting resistor RL3 is connected between the output at the drain of the transistor A310 and the positive terminal of a +5.3 kilovolt bulk direct-current power supply 300. The negative terminal of the power supply 300 is connected to the output lead 310.

A 25-kilohm reference resistor 311 for the first stage is connected between the input lead 301 and the gate of transistor A301, in parallel with the 680 picofarad capacitor C. The source of the first-stage transistor is connected to ground. The source of the transistor for each stage after the first is connected to the drain of the transistor of the preceding stage. The nine transistors A302, A303, . . . A309, A310 have their gates connected via respective reference resistors 321, 331, . . . 391, 3N1 to the sources of the preceding transistors A301, A302, . . . A308, A309 respectively. The ten transistors A301, A302, . . . A309, A310 have respective feedback resistors 312, 322, . . . 392, 3N2 connected between their drains and gates. Each of the reference and feedback resistors has a value of one megohm, except the first reference resistor 311.

The ten transistors A301, A302, . . . A309, A310 also have respective capacitors 412, 422, . . . 492, 4N2 connected between their drains and gates.

The DC voltage across the amplifier was set to 6.35 kilovolts. Before the capacitors were added, the DC regulation was measured. As the amplifier current increased from 5 milliamps to 10 milliamps, the voltage decreased to 6.34 KV, and at 30 milliamps to 6.32 KV, for a change of one half percent over a six to one load change. At higher frequencies the rejection was significantly less.

The addition of drain to gate capacitance gave much better rejection at power supply ripple frequencies. Although reliable data could not be obtained due to difficulties in measurement, a 1000 pf capacitor seemed to provide the best improvement. a 100 pf capacitor had little effect, and 10,000 pf was little better than 100 pf. This is in agreement with theoretical expectations, since the MOSFET gate capacitance is about 1000 pf.

A circuit like that of FIG. 4 could be constructed using all P-channel transistors, with the resistor from the last stage being connected to the negative terminal of the power supply 300.

It is understood that certain modifications to the invention as described may be made, as might occur to one with skill in the field of the invention, within the scope of the appended claims. Therefore, all embodiments contemplated hereunder which achieve the objects of the present invention have not been shown in complete detail. Other embodiments may be developed without departing from the scope of the appended claims.

What is claimed is:

1. A shunt voltage regulator used with a high voltage power supply having a series source impedance feeding a load, wherein the shunt voltage regulator comprises an amplifier connected shunting the load;

wherein said amplifier comprises a plurality of stages in tandem from a first stage to an Nth stage, each stage being a three-terminal unit having an input terminal, an output terminal and a common terminal, input means coupled between the input and common terminals of the first stage, the input means being coupled to an external signal source to command operation of the first stage, the output terminal of the Nth stage being coupled to the load;

each stage after the first having its input terminal coupled to the common terminal of the preceding stage, and its common terminal coupled to the output terminal of the preceding stage;

each stage comprising an amplifying device having an inverting input, a non-inverting input and an output, a reference resistor connected between the input terminal of each stage and the non-inverting input of each amplifying device, a feedback resistor connected between the inverting input and the output of each amplifying device, the non-inverting input of each amplifying device being the common terminal of the stage, and the output of each amplifying device being the output terminal of each corresponding stage.

2. A shunt voltage regulator according to claim 1, wherein in said amplifier there are at least a second stage and a third stage following said first stage, and at least for the third to the Nth stages, the reference and feedback resistors are of equal value to provide a gain of substantially one, with the gain of the amplifier being the sum of the gains of the stages;

wherein the amplifying device of each stage is an FET transistor, having a gate electrode used as the inverting input, a source electrode used as the non-inverting input, and a drain electrode used as the output; each stage having an external capacitor connected between the drain and gate to equalize the drain to gate and gate to source capacitances.

3. A shunt voltage regulator according to claim 2, wherein each stage further includes an external capacitor connected between the drain and source to provide lower amplifier impedance at high frequency.

4. A shunt voltage regulator according to claim 2, further including a lumped external capacitor connected between the drain of the Nth stage and the source of the first stage.

* * * * *